US010745252B2

(12) United States Patent
Kuismanen

(10) Patent No.: US 10,745,252 B2
(45) Date of Patent: Aug. 18, 2020

(54) MOVABLE CRANE ARRANGEMENT AND METHOD FOR ERECTING MOVABLE CRANE ARRANGEMENT

(71) Applicant: KONECRANES GLOBAL CORPORATION, Hyvinkää (FI)

(72) Inventor: Olli Kuismanen, Hyvinkää (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 138 days.

(21) Appl. No.: 15/772,608

(22) PCT Filed: Nov. 3, 2016

(86) PCT No.: PCT/FI2016/050777
§ 371 (c)(1),
(2) Date: May 1, 2018

(87) PCT Pub. No.: WO2017/077192
PCT Pub. Date: May 11, 2017

(65) Prior Publication Data

US 2019/0119081 A1 Apr. 25, 2019

(30) Foreign Application Priority Data

Nov. 4, 2015 (FI) ..... 20155803

(51) Int. Cl.
*B66C 19/02* (2006.01)
*B66C 23/20* (2006.01)

(52) U.S. Cl.
CPC ..... *B66C 19/02* (2013.01); *B66C 23/206* (2013.01); *B66C 2700/01* (2013.01)

(58) Field of Classification Search
CPC ..... B66C 19/00; B66C 19/02; B66C 23/20; B66C 23/206
See application file for complete search history.

(56) References Cited

U.S. PATENT DOCUMENTS 7,621,410 B1 11/2009 Updegrove et al.
7,726,497 B1 6/2010 Updegrove et al.
(Continued)

FOREIGN PATENT DOCUMENTS

EP 2 479 132 A2 7/2012
FI 124609 B 10/2014
(Continued)

OTHER PUBLICATIONS

Machine Translation of KR 2011/0092799 (Year: 2011).*
(Continued)

*Primary Examiner* — Michael R Mansen
*Assistant Examiner* — Juan J Campos, Jr.
(74) *Attorney, Agent, or Firm* — Birch, Stewart, Kolasch & Birch, LLP

(57) ABSTRACT

A movable crane arrangement includes a main girder for a trolley; end girders with running wheels to be supported on both ends of the main girder; running platforms for the running wheels of the end girders; and one elongated container, inside which at least part of the crane arrangement is placed in a disassembled or folded state for transport, if desired. One running platform is arranged to be implemented on the roof of the container at a selected height, and the other running platform is arranged to be implemented on the erecting platform of the crane arrangement. A method for erecting such a crane arrangement is also provided.

17 Claims, 5 Drawing Sheets

(56) References Cited

U.S. PATENT DOCUMENTS

| | | | | |
|---|---|---|---|---|
| 9,102,505 | B2 * | 8/2015 | Rosberg | B66C 23/206 |
| 2004/0060886 | A1 * | 4/2004 | Windbergs | B66C 9/08 212/179 |
| 2014/0190919 | A1 * | 7/2014 | Rosberg | B66C 23/206 212/179 |

FOREIGN PATENT DOCUMENTS

| | | | |
|---|---|---|---|
| FR | 2 420 502 | A1 | 10/1979 |
| KR | 10-2011-0092799 | A | 8/2011 |
| WO | WO 2013/014620 | A1 | 1/2013 |
| WO | WO 2013/150172 | A1 | 10/2013 |

OTHER PUBLICATIONS

Extended European Search Report for European Application No. 16861675.3, dated May 31, 2019.
International Search Report, issued in PCT/FI2016/050777, dated Feb. 13, 2017.
Written Opinion of the International Searching Authority, issued in PCT/FI2016/050777, dated Feb. 13, 2017.

* cited by examiner

MOVABLE CRANE ARRANGEMENT AND METHOD FOR ERECTING MOVABLE CRANE ARRANGEMENT

BACKGROUND OF THE INVENTION

The invention relates to a movable crane arrangement that comprises a main girder for a trolley; end girders with running wheels to be supported on both ends of the main girder; and running platforms for the running wheels of the end girders. The invention also relates to a method for erecting such a crane arrangement.

Publication FI 124609 B discloses a movable bridge crane arrangement that is suitable for use in field conditions, such as areas of crisis. A crane bridge with its winch is arranged on top of two containers positioned at a distance from each other to be movable on a support structure arranged at each time. Each support structure comprises a trussed structure built on top of the containers at a specific height above them to obtain the required lifting height. The space between the containers and trussed structure defines the working area of the bridge crane.

This crane arrangement that seems simple as such has some drawbacks, however. Firstly, this solution requires a separate auxiliary crane for erecting the actual crane arrangement. Transporting this type of auxiliary crane cross-country also requires additional arrangements. At the same time, erecting the crane arrangement takes too much time, which increases costs. To align two containers and to place them at the same height for a correct movement of a crane bridge may also be arduous, especially with a very uneven terrain. The strictly limited area between the two containers also restricts operations and logistics below the crane, when it is only possible to go under the crane from the open ends.

SUMMARY OF THE INVENTION

An object of the invention is thus to develop a new crane arrangement and a method for erecting the crane arrangement so as to enable the aforementioned problems to be solved. The object is achieved by the crane arrangement and method of the invention.

The crane arrangement of the invention is characterised in that it also comprises one elongated transport container, inside which at least part of the crane arrangement can be placed, if desired, in a disassembled or folded state for transport; that one running platform is arranged to be implemented on the roof of the container at a selected height, and the other running platform is arranged to be implemented on the erection platform of the crane arrangement.

For erecting the crane arrangement, there may also preferably be auxiliary erecting means that comprise erecting columns supported to the container and lifting devices fastened to the erecting columns, and at least part of the auxiliary erecting means may be fitted into the same container, if desired.

The method of the invention is characterised by arranging one elongated transport container; arranging auxiliary erecting means for the crane arrangement, which comprise erecting columns and lifting devices, the erecting columns being supported and fastened to the container and the lifting devices being fastened to the erecting columns; arranging one running platform on the roof of the container at a selected height; arranging another running platform on the erection platform of the crane arrangement; and lifting with winches or cable pulleys the main girder to the end girder and together with possible vertical legs between the main girder and end girders up by means of the auxiliary erecting means, and setting the end girders on the running platforms.

Other preferred embodiments of the invention are disclosed in the dependent claims.

The invention is based on the fact that this one container forms the "frame" of one side of the crane arrangement and the terrain or the platform on the installation site forms the "frame" of the other side for the movement of the main girder. This way, the available area is more open than before. Erecting (and dismantling) the crane arrangement does not require a separate auxiliary crane, but the light-weight auxiliary erecting means are sufficient to do this. At the same time, at least the main part (if not all) of the crane equipment and also the auxiliary erecting means can be fitted into only one container for transport. When one of the long sides of the container is preferably also made to open, loading goods in the container and unloading them from it is easy, and additional working space is also created within the operating area of the crane arrangement.

The crane arrangement is especially well-suited for the maintenance and repair of different vehicles and other machines and devices both in normal and crisis or war conditions, for temporary material logistics in different lines of business, and for handling lifting needs in inexpensive and rapidly-built production. The assembly and disassembly of the arrangement is easy. The solution is practical for transient or temporary use. It is also independent and, therefore, does not set any specific requirements for the environment or external help. During installation, the mass of the container serves as a counterweight and there is no need to worry about positioning and alignments in the same manner as in the two-container solution. In addition, the point of support of the load caused by the crane is at the container-side end always inside the points of support (corners) of the container.

LIST OF FIGURES

The invention will now be described in more detail in connection with preferred embodiments and with reference to the accompanying drawings, in which FIG. 1 shows the initial step in erecting the crane arrangement according to the invention;

DETAILED DESCRIPTION OF THE INVENTION

Figure 1:
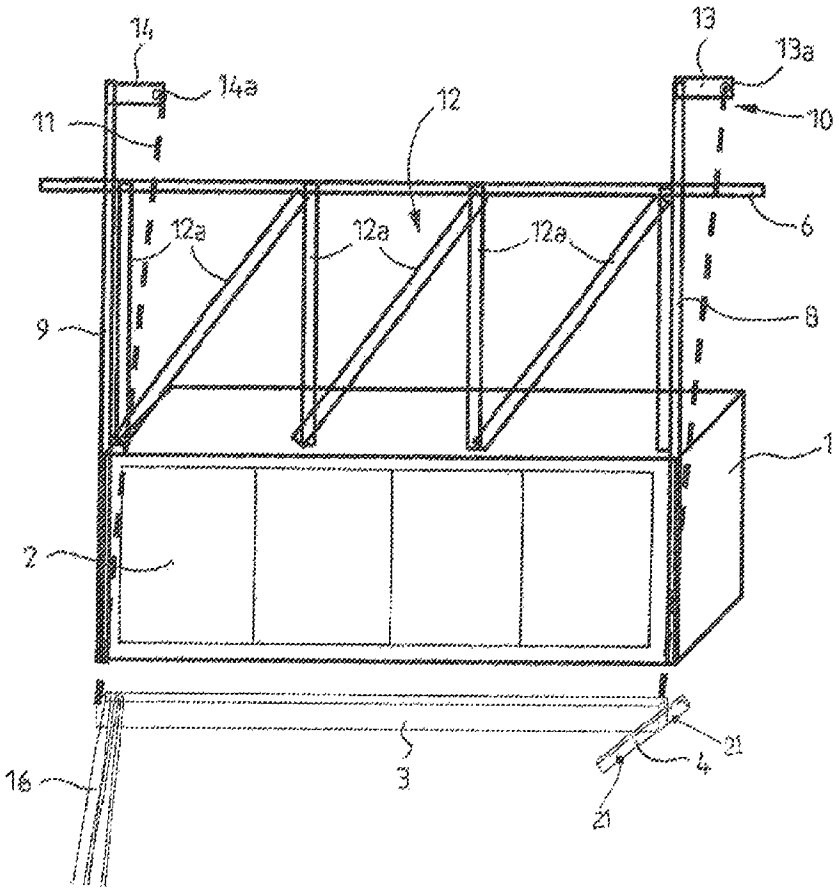
Figure 2:
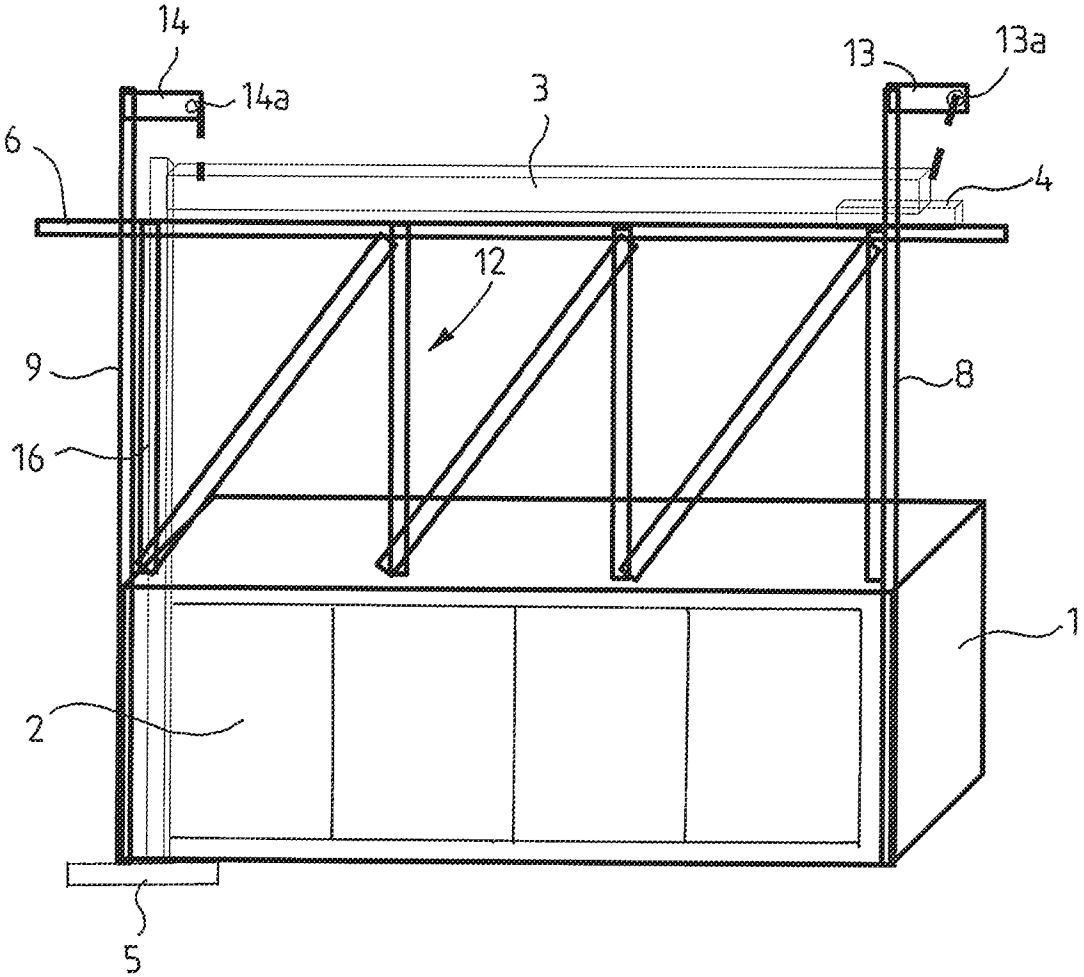
FIG. 2 shows the hoisting of the main girder of the crane arrangement according to FIG. 1.
Figure 3:
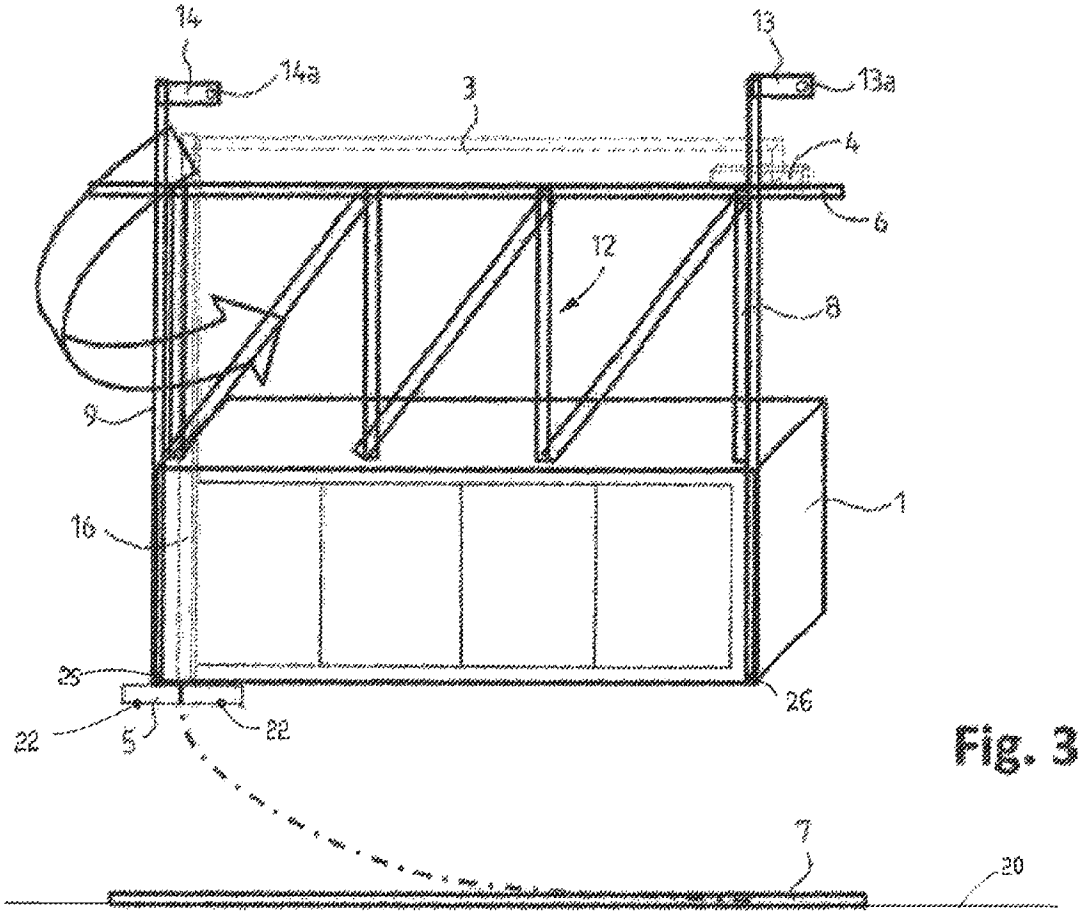
FIG. 3 shows the turning of the main girder of the crane arrangement shown in the previous figures.

With reference to FIGS. 1 to 4, the movable crane arrangement shown therein comprises firstly one elongated transport container 1, in which preferably one long side thereof is made to open by means of a door arrangement 2. The door arrangement can also be at the end of the container 1 or on its roof, if desired. The crane arrangement further comprises a main girder 3 for a trolley (not shown); end girders 4 and 5 supported on both ends of the main girder 3 and having running wheels 21, 22 (shown in FIGS. 1 and 3); and running platforms 6 and 7 for the running wheels of the end girders 4 and 5. The components mentioned last are preferably at least mainly placed inside the container 1 in a disassembled or folded state during transport. The crane arrangement also comprises auxiliary erecting means comprising erecting columns 8 and 9 to be supported to the container 1 and lifting devices 10 and 11 to be fastened to the erecting columns 8 and 9. The lifting devices 10 and 11 may be cable pulleys, winches or chain hoists, for instance. Only their chains or ropes 10 and 11 are shown of these lifting devices. The lifting devices 10 and 11 may be motor-driven, manual or even horse-driven. These auxiliary erecting means are preferably also mainly placed inside the container during the transportation of the crane arrangement The arrangement according to FIGS. 1 to 4 also contains a support structure 12 of one running platform 6, which may also be placed inside the container 1 during transport. The specific part of this crane arrangement is that one running platform 6 is arranged to be mounted on the roof of the container 1 at a selected height and the other running platform 7 is arranged to be positioned on the erection platform 20 of the crane arrangement.

When a crane arrangement according to the invention as shown in FIGS. 1 to 4 is to be erected, the above-mentioned container 1 preferably containing at least the main part of the above-mentioned components is brought to the selected area by a truck, for instance. The container 1 is lowered on the ground, its door arrangement 2 is opened, and the components inside are taken out.

The erecting columns 8 and 9 are first fastened to the opposite end corners on the door-side of the container 1 at for example, fastening points 25, 26, to their bottom and top parts, for instance to standard-shaped notches on the outer surfaces of the corner pieces in the container 1. The erecting columns 8 and 9 are made to extend to a selected height above the container 1, the erecting columns 8 and 9 are here approximately 3 times the height of the container 1. The ends of the erecting columns 8 and 9 have lateral projections 13 and 14 with lifting eyes 13*a* and 14.

Of course, the erecting columns could also be A-trestles or steep rails extending from the rear side of the container 1. The only essential thing is to have sufficiently robust and high lifting supports close to the container 1 for the purpose of erecting the crane.

After this, a support structure 12 consisting of lattices 12*a* is built on top of the container 1 for one running platform 6 by using standard corner locks in the standard corner pieces of the container 1, and the running platform 6 is mounted on top of this support structure 12 preferably by using the lifting devices 10 and 11 that are supported to the lifting eyes 13*a* and 14*a* of the erecting columns 8 and 9.

The second running platform 7 is mounted on the erection platform of the crane arrangement at a distance corresponding to the length of the main girder 3 from the container 1 and parallel to the container 1.

Next, the lifting devices 10 and 11 are used to lift the main girder 3 from both its ends together with the end girders 4 and 5 and the vertical legs 16 between the main girder 3 and end girder 5 up to be initially parallel to the container. There is a hinge (not shown) between the end girder 5 and vertical legs 16 and the vertical legs 16 are straightened before lifting or during lifting. Finally, the main girder 3 is turned in such a manner that the end girder 4 on the container 1 side is at an approximately 90° angle to the main girder 3, and the end girder 5 that is away from the container 1 is placed on the running platform 7. When turning the main girder 3, the end girder 4 on the container 1 side may already be on its running platform 6, if there is a flexible rotating coupling between the main girder 3 and end girder 4. However, if there is only a rotating coupling between the main girder 3 and end girder 4, the end girder 4 is lowered to its running platform 6 only after the main girder 3 has been turned and the end girder 5 that is away from the container 1 has been lowered on its running platform 7.

The trolley (not shown) may be already fastened to the main girder 3 when the main girder 3 is lifted or it may be mounted in place only after the main girder 3 is in place.

When the crane arrangement is operational, the erecting columns 8 and 9 and the lifting devices 10 and 11 can be dismantled.

Figure 4:
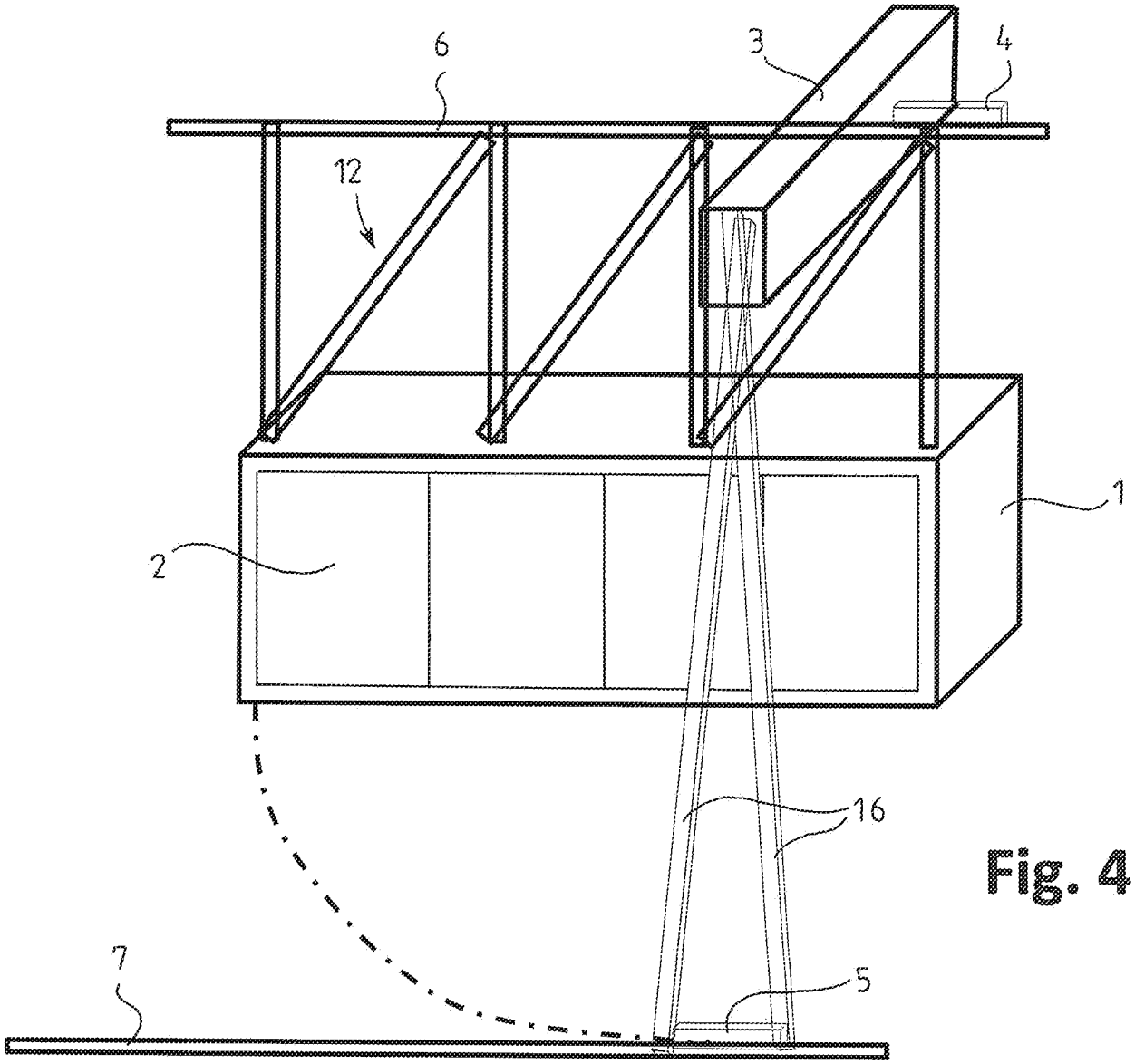
FIG. 4 shows the crane arrangement shown in the previous figures in its final position.
Figure 5:
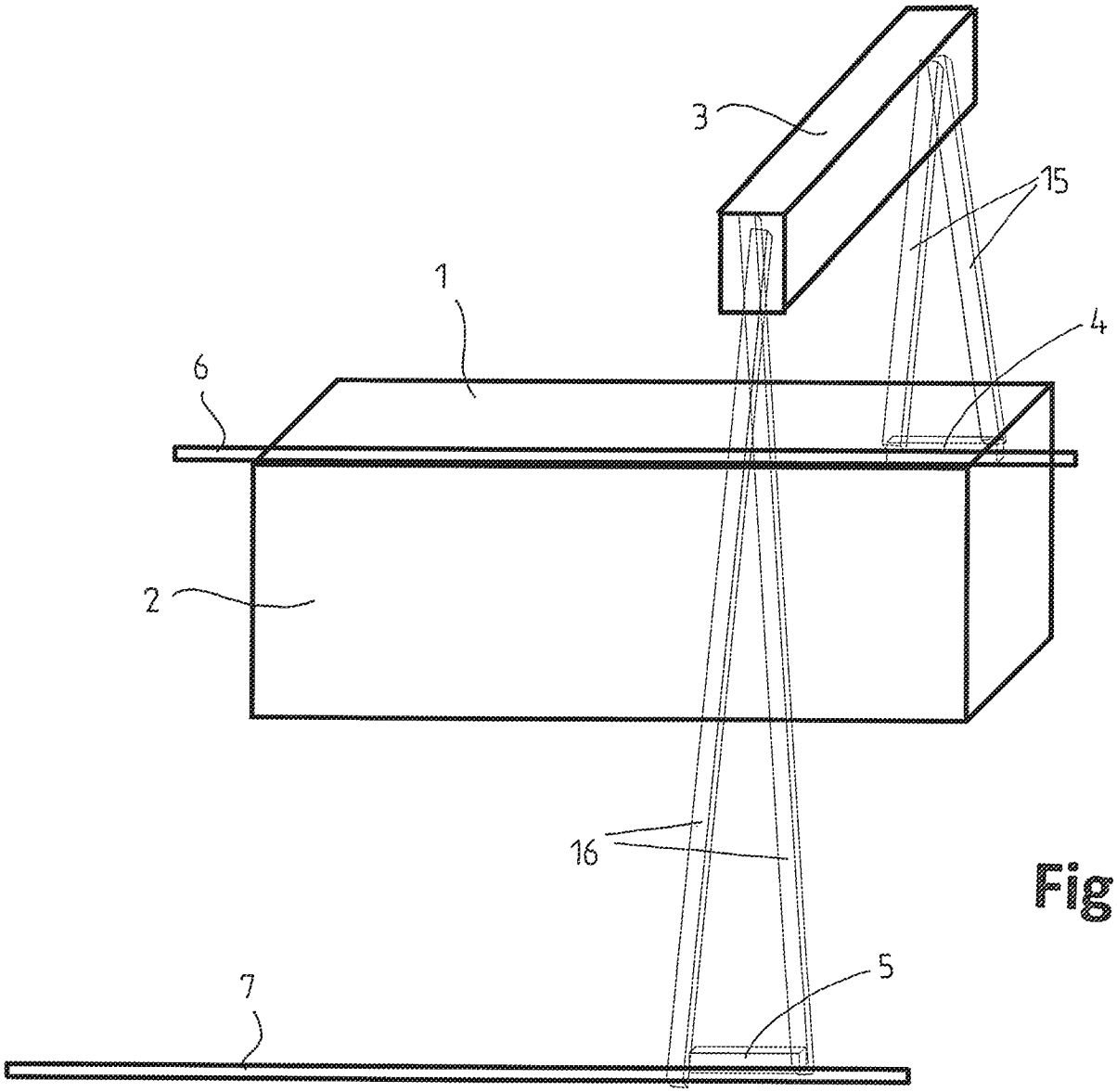
FIG. 5 shows an alternative crane arrangement according to the invention.

FIG. 5 shows a crane arrangement according to the invention, but slightly modified from the solution of FIGS. 1 to 4, in its final position according to FIG. 4. The support structure 12 according to FIGS. 1 to 4 is missing from it, because the running platform 6 is mounted directly on the roof of the container 1. Correspondingly, the construction step of the support structure 12 described above is excluded, but otherwise the erection of this crane arrangement corresponds substantially to the erection of the crane arrangement according to FIGS. 1 to 4. Instead of a raised running platform, this solution also has a support leg structure on the container 1 side, i.e. support legs 15 between the main girder 3 and end girder 4. Their existence does not essentially alter the method described above, the only addition is the straightening step of the support legs 15. It is also possible to use the above-mentioned corner locks and corner pieces in the fastening of this structure.

As for the running platforms 6 and 7 mentioned above, their structure depends on whether rubber wheels, plastic wheels, or railway wheels are used as the running wheels. If railway wheels are used, the running platforms are rails. If sufficiently large rubber wheels are used, the running platform 7 away from the container 1 could be the actual positioning platform of the crane arrangement, even the ground, if it is hard enough.

The present invention is only intended to illustrate the basic idea of the invention. A person skilled in the art may vary its details within the scope of the attached claims.

The invention claimed is:

1. A movable crane arrangement comprising:

a main girder for a trolley;

end girders with running wheels to be supported on both ends of the main girder;

running platforms for the running wheels of the end girders; and one elongated transport container, inside which at least part of the crane arrangement can be placed, in a disassembled or folded state for transport, wherein one of said running platforms is arranged to be implemented on a roof of the container at a selected height, and another one of said running platforms is arranged to be implemented on an erection platform of the crane arrangement, and wherein auxiliary erecting means comprise erecting columns supported to the container, and lifting devices fastened to the erecting columns, and at least part of the auxiliary erecting are fitted into the same container.

2. The movable crane arrangement as claimed in claim 1, wherein the lifting devices are selected from a group that consists of at least a winch, tackle, and a chain hoist.

3. The movable crane arrangement as claimed in claim 1, wherein a long side of the container opens.

4. The movable crane arrangement as claimed in claim 1, wherein fastening points of the erecting columns are at opposite end corners of the container, and the erecting columns extend to a selected height above the container.

5. A method for erecting a movable crane arrangement that comprises a main girder for a trolley; end girders with running wheels to be supported on both ends of the main girder; and running platforms for the running wheels of the end girders, said method comprising the steps of:

providing one elongated container;

providing auxiliary erecting means for the crane arrangement that comprise erecting columns and lifting devices, wherein the erecting columns are supported and fastened to the container and the lifting devices are fastened to the erecting columns;

providing one of said running platforms on a roof of the container at a selected height;

providing another of said running platforms on an erection platform of the crane arrangement; and lifting with the lifting devices the main girder and the end girder up by means of the auxiliary erecting means, and lowering the end girders on the running platforms.

6. The method as claimed in claim 5, further comprising the step of arranging a long side of the container to open.

7. The method as claimed in claim 6, further comprising the step of arranging at least part of the crane arrangement inside said container in a disassembled or folded state for transport, when the crane arrangement is brought to the erecting site or taken away from the erecting site.

8. The method as claimed in claim 5, further comprising the step of arranging at least part of the crane arrangement inside said container in a disassembled or folded state for transport, when the crane arrangement is brought to the erecting site or taken away from the erecting site.

9. The method as claimed in claim 5, further comprising the step of arranging at least part of the auxiliary erecting means inside said container, when the crane arrangement is brought to the erecting site or taken away from the erecting site.

10. The method as claimed in claim 5, further comprising the step of fastening the erecting columns to opposite end corners of the container in such a manner that erecting columns extend to a selected height above the container.

11. The method as claimed in claim 5, wherein the lifting devices are selected from a group that consists of at least a winch, tackle, and a chain hoist.

12. The method as claimed in claim 5, wherein the main girder with the end girders are first lifted up to be parallel to the container, and next the main girder is turned so that one of the end girders that is on the container side enters an approximately 90° angle in relation to the main girder.

13. The method as claimed in claim 12, wherein the main girder is turned when one of the end girders that is on the container side is already on a corresponding one of the running platforms.

14. The method as claimed in claim 12, wherein one of the end girders that is on the container side is lowered on a corresponding one of the running platforms only after the main girder has been turned.

15. The method as claimed in claim 5, wherein said one of the running platforms is arranged on a support structure on the roof of the container, and said auxiliary erecting means of the crane arrangement are used in erecting the support structure.

16. The method as claimed in claim 5, wherein the crane arrangement further comprises vertical legs between the main girder and end girders, and the step of lifting comprises lifting with the lifting devices the main girder and the end girder together with the vertical legs up by means of the auxiliary erecting means.

17. The method as claimed in claim 16, wherein the main girder with the end girders and the vertical legs between the main girder and end girders are first lifted up to be parallel to the container, and next the main girder is turned so that the end girder on the container side enters an approximately 90° angle in relation to the main girder.

* * * * *